US006508066B1

(12) United States Patent
Mierins et al.

(10) Patent No.: US 6,508,066 B1
(45) Date of Patent: Jan. 21, 2003

(54) SINGLE COIL DUAL PATH DEHUMIDIFICATION SYSTEM

(76) Inventors: Raymond A. Mierins, 100 Redpath Ave., Suite 20, Toronto Ontario (CA), M4S 2J7; Bryan Elliott, 59 Third Ave. North, Uxbridge, Ontario (CA), L9F 1V5

( * ) Notice: Subject to any disclaimer, the term of this patent is extended or adjusted under 35 U.S.C. 154(b) by 0 days.

(21) Appl. No.: 09/648,100

(22) Filed: Aug. 25, 2000

(51) Int. Cl.[7] ..... F25D 17/06
(52) U.S. Cl. ..... 62/97; 62/93; 62/427
(58) Field of Search ..... 62/427, 93, 97, 62/94, 271, 176.6, 426; 236/49.4, 44 C, 13, 49.5

(56) References Cited

U.S. PATENT DOCUMENTS 2,338,382 A * 1/1944 Marlow
4,044,947 A * 8/1977 Spethmann ..... 236/13
4,210,278 A * 7/1980 Obler ..... 236/49.4
4,399,864 A * 8/1983 Lamar ..... 236/44 C
4,540,118 A * 9/1985 Lortie et al. ..... 236/44 C
4,841,733 A * 6/1989 Dussault et al. ..... 62/93
5,257,958 A * 11/1993 Jagers ..... 236/13 X
5,346,127 A * 9/1994 Creighton ..... 236/13
5,548,970 A * 8/1996 Cunningham, Jr. et al. ... 62/271

* cited by examiner

*Primary Examiner*—Chen-Wen Jiang
(74) *Attorney, Agent, or Firm*—Synnestvedt & Lechner LLP

(57) ABSTRACT

A dual path single coil dehumidification system is provided. The system includes a housing that is mounted onto the top of a building that is to be dehumidified. The system draws in outside air which is circulated along its own dedicated path. A cooling coil is disposed in the dedicated outside air path. The outside air therefore passes over the cooling coil and is dehumidified prior to being mixed with any other air. The system also draws in return air from the interior of the building. The system is arranged so that the return air is drawn over refrigeration units that are located in the building to cool the return air. The cooled return air is then drawn into the housing where it is mixed with the outside air only after the outside air passes over the cooling coil. The mixed dehumidified outside air and the cooled return air form a supply air stream that is delivered to the interior of the building.

10 Claims, 6 Drawing Sheets

SINGLE COIL DUAL PATH DEHUMIDIFICATION SYSTEM

FIELD OF THE INVENTION

The invention relates to dehumidification systems for interior enclosed spaces.

BACKGROUND

High levels of heat and humidity cause food items to perish more quickly. This is mainly due to the more rapid proliferation of bacteria and other micro-organisms such as fungi under these conditions. The profitability of businesses that sell perishable foods is directly affected by the length of time that food items can be stored on display shelves that are visible to customers. It is therefore very important to maintain a dehumidified environment in enclosed areas where perishable food items are stored for lengthy periods of time. This is especially the case in a supermarket environment. As well, the refrigeration energy required to operate refrigeration units is reduced with lower humidity levels.

Supermarkets typically rely on air conditioning systems for lowering temperature. These systems often have little or no dehumidifying capability. Typical air conditioning systems combine outside air and return air. This air is then directed to a cooling coil that cools the combined air stream. However, humidity is most concentrated in the outside air. This system is very inefficient for dehumidifying because the more humid outside air is mixed with the return air prior to the dehumidification step. In order for the humidity to be removed, the entire combined air stream needs to cooled down to very low temperatures. In most cases the cooled combined air stream requires re-heating so as not to overcool the space and make it uncomfortable for occupants. This system is an expensive and very inefficient for dehumidification applications.

An improvement to the typical system is provided by a cooling coil bypass. The improved system combines outside and return air streams. However, a portion of the air bypasses the cooling coil. The remainder of the air stream passes over the cooling coil and is cooled down. This method allows for a portion for the air to be cooled to very low temperatures with a moderate amount of cooling capacity.

A disadvantage of this system is that a portion of the air bypasses the cooling coil and is therefore completely untreated. Another disadvantage is that the main source of humidity, the outside air, is diluted and mixed with the return air before the humidity is removed. This is inefficient.

Another improvement was to add a face and bypass damper. This allows better control of the off coil temperatures and air quantities but the main disadvantages of the previous systems persist.

A two coil dual-path system overcomes some of the drawbacks of previous systems. This system has two distinct and dedicated air paths. One air path is for the outside air and the other is for the return air. Each path has its own cooling circuit and coil that operates independently of the other. The dedicated outside air path targets the outside air directly to cool and remove the humidity at the source. A parallel return air path operates similarly. However, the design typically focuses on sensible cooling i.e. strict temperature reduction rather than dehumidification. Once the two air streams have been treated they are then mixed together.

The two coil dual-path system has the advantage of targeting the humidity of the outside air. This provides greater dehumidifying efficiency. However, this system requires a great deal of cooling tonnage to operate. This is a significant drawback that results in elevated operating expense.

There is therefore a need for a dual path dehumidification system that cools and dehumidifies outside air prior to mixing the outside air with return air. There is a need for such a system that is energy efficient and relatively inexpensive to operate. There is a need for such a system that includes a single cooling coil that provides effective cooling results with no cooling coil in the return air path. There is a further need for such a system that is optimized for supermarket application.

SUMMARY OF THE INVENTION

The present invention provides a dual path dehumidification system for dehumidifying the interior of a structure. The system dehumidifies outside air separately from re-circulated return air. The system employs a single cooling coil for dehumidifying outside air. The system draws return air from a refrigeration unit located in the structure in order to provide additional cooling.

The system has the advantage that the outside air is isolated for dehumidification and the return air travels along its own dedicated path with no cooling coil. The return air is cooled by the refrigeration units located in the space that is to be dehumidified. The outside and return air streams are mixed only after the outside air stream has been dehumidified. This system has the advantages of a two coil dual-path system, however, total system tonnage is reduced by virtue of the fact that only a single cooling coil is employed. The system is energy efficient and inexpensive compared to previous dehumidification systems.

According to one aspect of the present invention, there is provided a dual path dehumidification system for dehumidifying air and circulating the air through an interior space defined by an exterior structure of a building. The air includes outside air derived from an outside air source and return air from the space. A refrigeration unit is located in the space. The system comprises the following elements:

- a supply inlet communicating with said space for passage of dehumidified air to said space;
- an outside air path for passage of outside air to the supply inlet, the outside air path communicating between the exterior of the building and the supply inlet, said outside air path being connected to said outside air source;
- a cooling unit disposed in said outside air path, the cooling unit including an inlet for receiving outside air and an outlet for flow of cooled and dehumidified outside air to said outside air path;
- a return air path for passage of air in the space to the supply inlet, the return air path communicating with the refrigeration unit so that the return air is drawn from the refrigeration unit thereby cooling the return air, the return air path joining the outside air a path at a point between the cooling unit and the supply inlet; and
- a fan operatively connected to the outside air path, the return air path and the supply inlet for circulating the air through the outside air path, the return air path and the supply inlet.

According to another aspect of the present invention, there is provided a method for dehumidifying an interior space defined by a building. The interior space has a refrigeration unit. The method comprises the following steps:

providing an outside air path that communicates between an exterior of the building and the space, the outside air path having a cooling unit disposed therein;

delivering outside air from the exterior of the building into the outside air path;

cooling and dehumidifying the air delivered into the outside air path;

delivering the cooled and dehumidified air from the outside air path to the space;

providing a return air path, the refrigeration unit being disposed in the return air path so that return air is drawn from the refrigeration unit;

drawing air through the return air path so that the air is cooled by the refrigeration unit;

circulating the cooled air from the return air path outside of the space; and joining the cooled air from the return air path to the cooled and dehumidified air from the outside air path to create a combined air steam; and delivering the combined air steam to the space.

IN THE DRAWINGS

DETAILED DESCRIPTION

Figure 1:
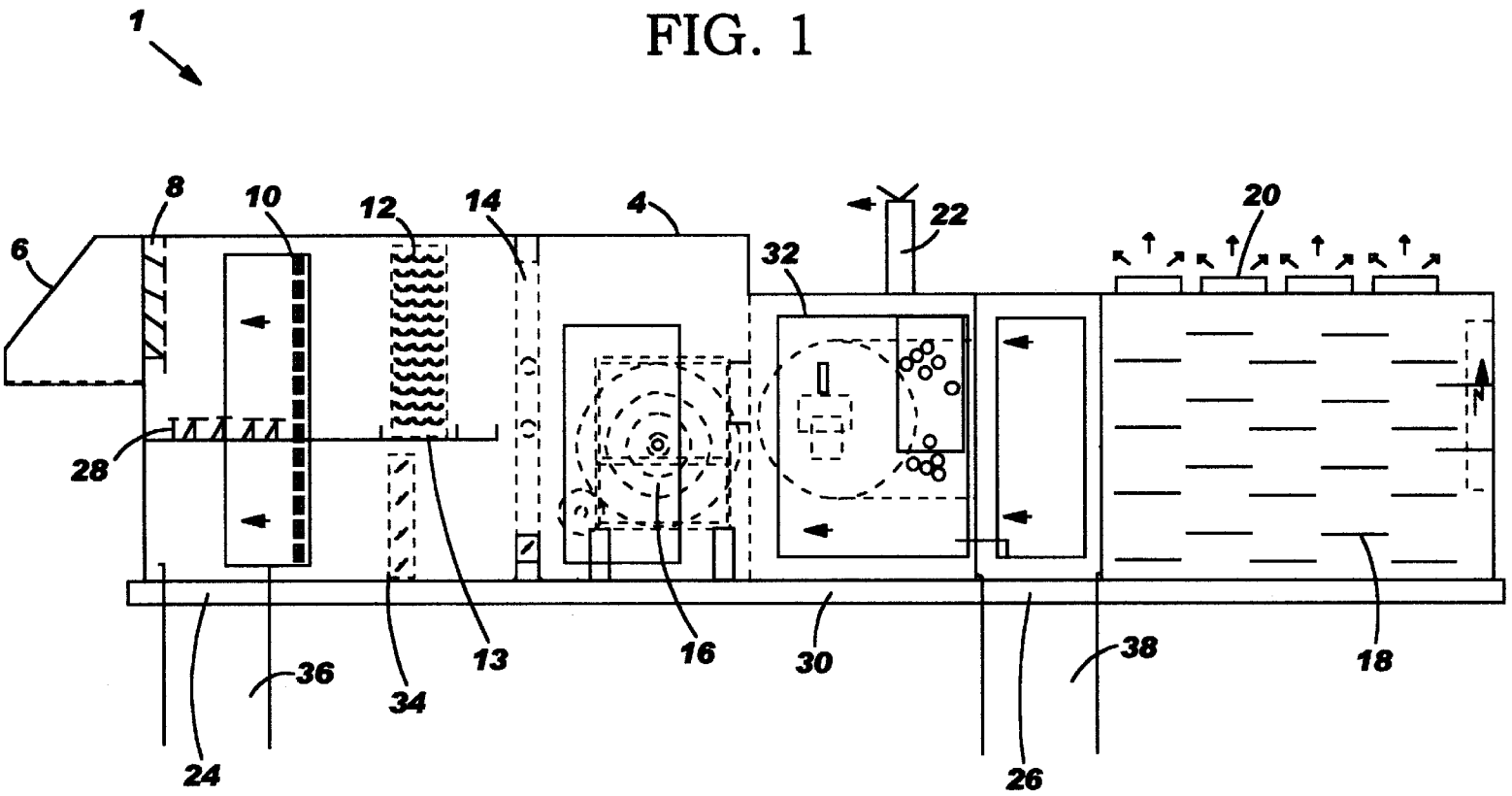
FIG. 1 is a side elevation view of a preferred embodiment of the present invention.
Figure 2:
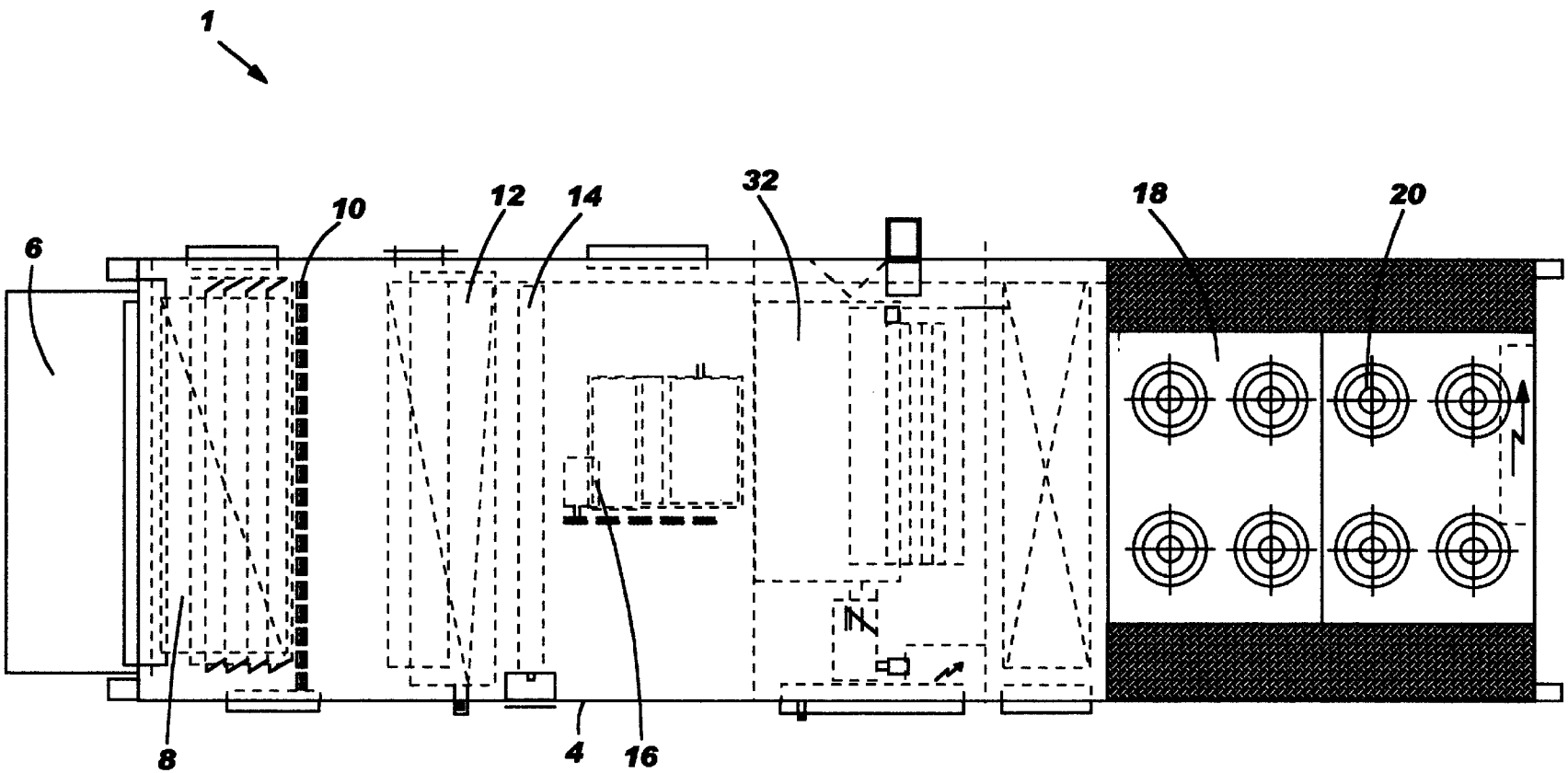
FIG. 2 is a plan view of the preferred embodiment.

As shown in FIGS. 1 and 2, dual path dehumidification system 1 comprises an exterior housing 4. Preferably, the housing 4 is mounted on a roof of a structure (not shown), the interior of which is to be dehumidified. Unit base channel 30 is preferably employed to mount the housing 4 onto a roof curb which can be attached to the roof of the structure.

The housing 4 has an outside air inlet 6 through which outside air enters the housing 4. An outside air damper 8 is located within the housing 4 near the outside air inlet 6. Preferably, an air filter 10 is located in the housing 4. The outside air preferably passes through the air filter 10 before passing over a cooling coil 12. An airflow monitoring station may also be included near the outside air inlet 6. The amount of outside air the dehumidification system is designed to process typically depends on the amount of airflow required by occupancy codes. The amount of airflow required to supply slightly more outside air to the supermarket space than that is exhausted is also a consideration. In smaller systems, the amount of outside air is typically constant. Control strategies may include a routine varying the amount of outside air to the interior space of the structure. An airflow station could be used to accurately determine the amount of outside air entering the system. In alternate embodiments outside air temperature and humidity sensors can be located near the outside air inlet 6. This is useful for determining system capacity and verifying operation.

The housing 4 also has a return air inlet 24 for entry of return air from the structure into the housing 4. A return air duct 36 communicates with the housing 4. The return air duct 36 communicates with the return air inlet 24 so that return air that flows into the housing 4 through the return air inlet 24 is received into the return air duct 36.

A bypass damper 28 is located in the housing 4. The bypass damper 28 is movable between an open position and a closed position. When the bypass damper 28 is moved toward the closed position, the outside air and the return air are kept separate. When the bypass damper 28 is moved toward the open position, the return air passes through the bypass damper 28 and the outside air and the return air are mixed. A return air damper 34 is located in the housing for operation in conjunction with the bypass damper 28 to control air flow across the cooling coil 12.

Cooling coil 12 is located within the housing 4. When the bypass damper 28 is moved toward the closed position, only outside air passes through the cooling coil 12. When the bypass damper 28 is moved toward the open position, then mixed outside air and return air passes through the cooling coil 12. Cooling coil 12 is preferably refrigerant (DX), brine or chilled water type. The cooling coil is used to cool and dehumidify the air. Air travels through and is cooled by the cooling coil 12. When the dew point temperature of the air is reached, the moisture in the air condenses on the cooling coil 12. The water runs down the cooling coil 12, collects in a drain pan 13 located under the cooling coil 12 and is removed through a drainage line. If the air velocity across the coil is too fast, the water draining off a leaving face of the cooling coil 12 will be blown into the air stream missing the drain pan and collecting in unwanted areas. The cooling capacity of the system is determined by cooling the outside air to a dew point temperature far enough below the space dew point set point so as to obtain a latent credit. The cooling coil 12 is typically sized for low velocities (~300 fpm) for dehumidification purposes. This low velocity also allows for increased coil airflow when bypassing return air for increased sensible cooling without the risk of moisture carryover. Industry practice is to keep coil velocities below 550 fpm so as to avoid moisture carryover.

In alternate embodiments, a differential pressure transmitter can be located near the cooling coil 12. This provides a means for determining the amount of air passing across the cooling coil. The coil differential pressure is an input used in controlling damper operation to obtain the coil velocities as required. Alternatively, the various damper positioning/settings can be field tested and set in a control logic for the various modes of operation.

In another alternate embodiment, a leaving coil air and temperature averaging sensor can be included near the cooling coil 12. The average temperature of the air leaving the cooling coil is used in the control routines, particularly to avoid a freeze condition and as a data point of interest and for verifying operation and cooling capacity. Other control methods can include freeze protection by monitoring coil refrigerant temperatures and/or pressures.

A heat reclaim coil 14 is preferably located in the housing for remaining heat that is rejected by units in the interior space. This heat can be used to heat supply air to be delivered to the interior space of the structure, if necessary.

A heating section 32 is located within the housing 4. Where the outside air temperature is very low, it is necessary to heat the supply air prior to introduction into the interior space of the structure.

A supply air duct 38 communicates with the housing 4. A supply air outlet 26 communicates with the supply air duct 38 so that supply air can pass from the housing 4 into the interior space of the structure. A fan 16 is located in the housing 4 for circulating supply air to be delivered to the interior space of the structure. The fan blows supply air into the supply air duct 38.

A condensing unit 18 is located within the housing 4. Condenser fans 20 are located on the housing for circulating outside air over the condenser coils. A heat exchange unit 32 is located within the housing 4 for heating supply air, if necessary. A chimney 22 is located on the housing 22 for exhausting combustion fumes.

Figure 3:
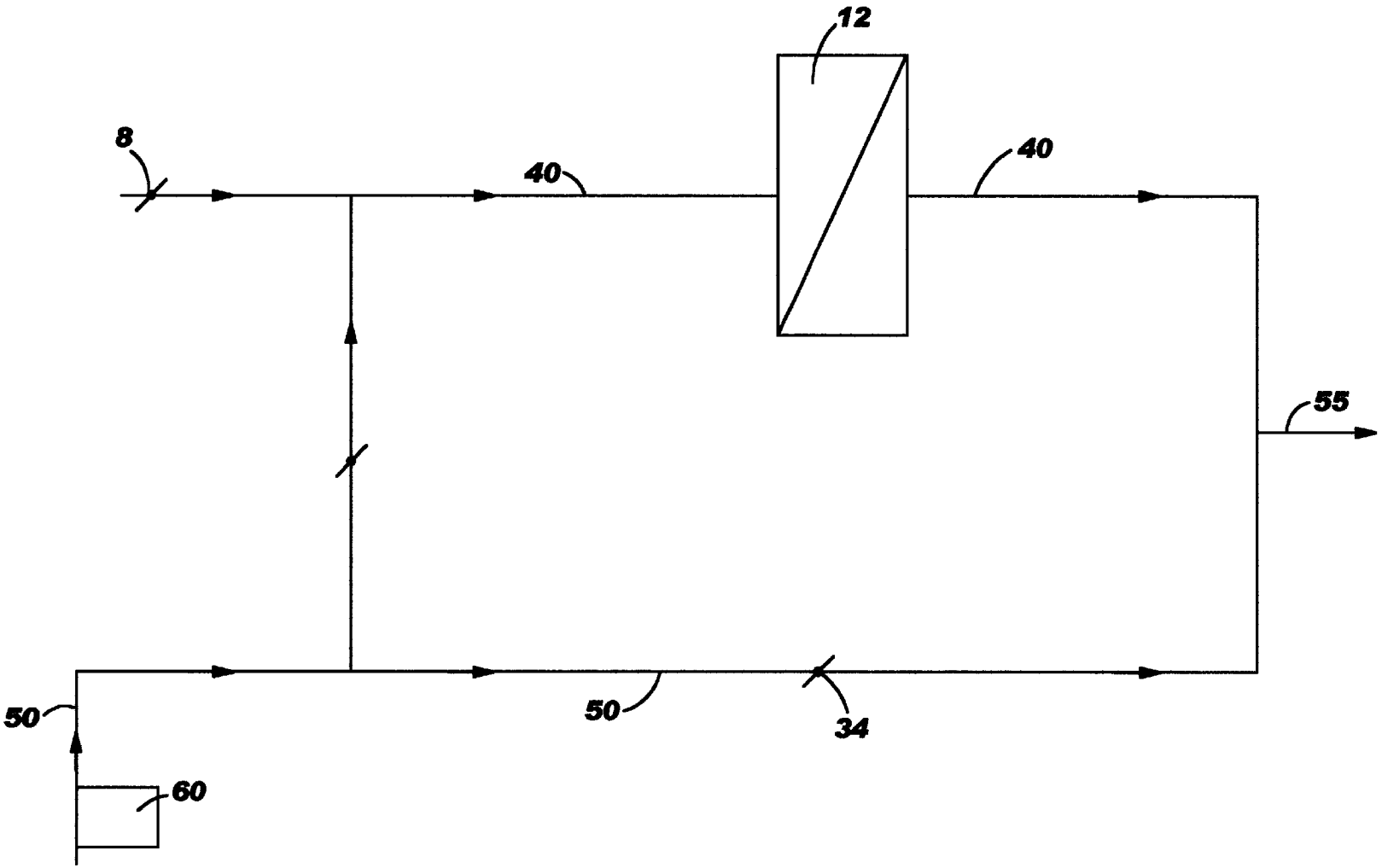
FIG. 3 is a flow chart that shows a flow of outside air and return air through the system.

The operation of the system is shown schematically in FIG. 3. Outside air is suctioned into the outside air inlet 6 of the housing 4 through the action of a fan (not shown). The outside air travels through an outside air path 40. The outside air path is a dedicated air path. A dedicated air path is an air path where the air entering the path is not mixed or disturbed. The outside air enters the cooling coil 12. The outside air is dehumidified and cooled as it passes over the cooling coil 12. Latent cooling therefore occurs at this point. Latent cooling refers to moisture removal from the air. Latent heat that is removed from the air condenses some of the moisture in the air.

The cooled and dehumidified outside air is mixed with the return air in the supply air duct 38. The mixed air is then blown into the interior space through the supply air duct 38 and the supply air outlet 26.The supply air enters the interior space through supply air path 55. The supply air is blown into interior space through the action of the fan 16.

Figure 4:
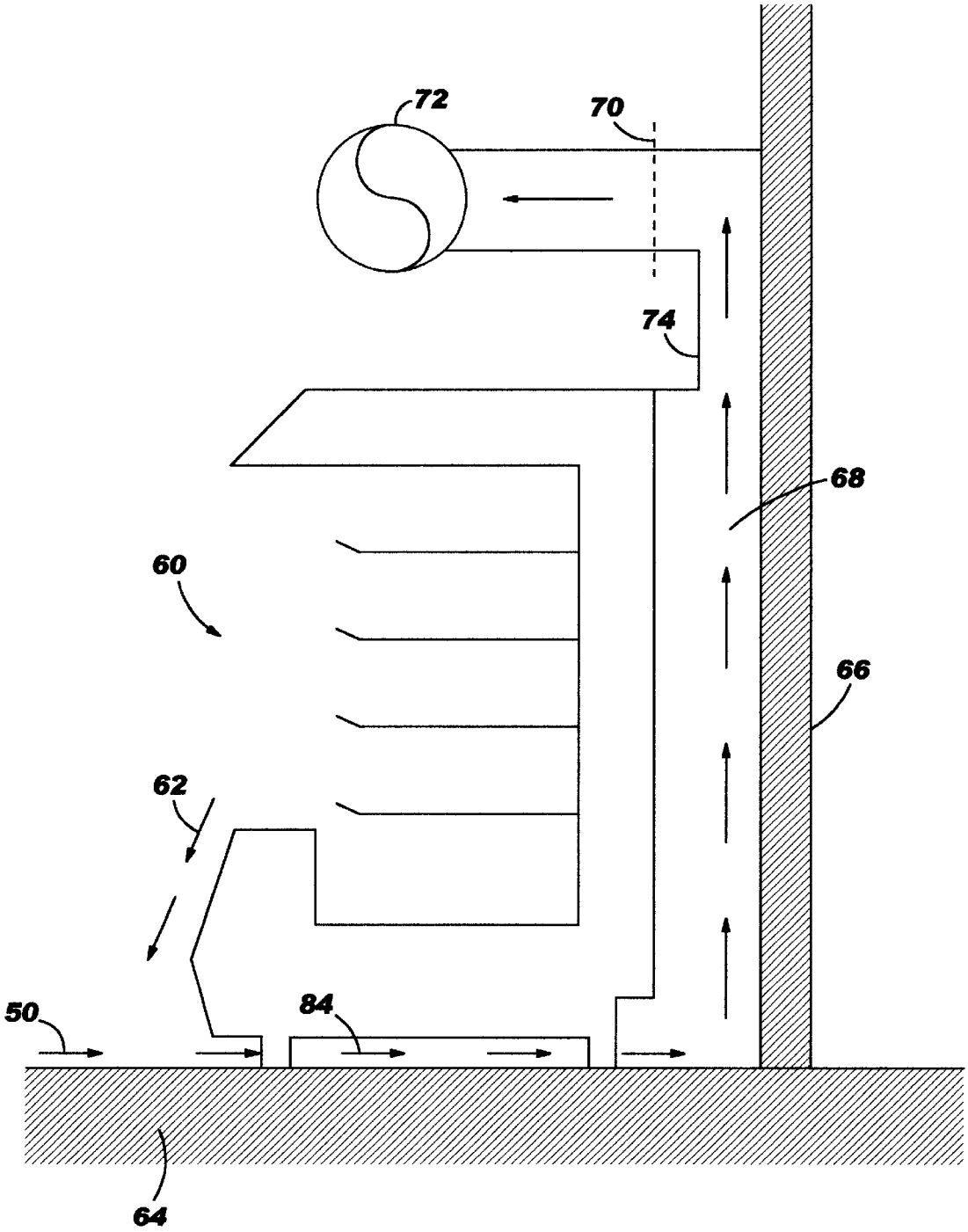
FIG. 4 is a perspective view of a drop style undercase return shown in association with a flow of return air.

Return air path 50 is shown in FIG. 3. The system is most effective where the interior space has a refrigeration unit or other cooling source. A refrigeration unit includes any unit or source that produces cold air or cools ambient air. Preferably, the refrigeration unit is a refrigerated display case 60. Most preferably, the interior space is a supermarket and the refrigeration unit comprises a refrigerated display case that produces cold air to maintain retail product integrity. Supermarkets typically have many refrigerated display cases. As shown in FIG. 4, cold air from the display case 60 spills over the sides and onto the floor. The refrigerated display case 60 preferably forms a gap 68 between it and a wall 66. Air is drawn from under the case and up the gap 66. The return air is then ducted back to the return air duct 36 through the return air inlet 24. This process is referred to as undercase return.

With undercase return, the system draws the return air from under the refrigerated display case 60. This results in a large cooling credit to the supermarket air conditioning system. This provides increased efficiency and reduced operating costs.

FIG. 4 depicts an embodiment of the present invention but is employed in conjunction with a drop style undercase return. Cold air 62 spills out of a refrigerated display case 60. The cold air 62 sinks to a floor 64 of the interior space. The cold air 64 combines with return air path 50 to form a cooled return air stream 84 that circulates along the floor due to the action of the fan 16. A gap 68 is formed between the display case 60 and a wall 66. The gap 68 is air tight due to the presence of an air tight seal 74. The cooled return air 84 is circulated up the wall 66 along the gap 68 to a return air duct 72. The cooled return air 84 moves through the return air duct 72 to the main return air duct 36.

Figure 5:
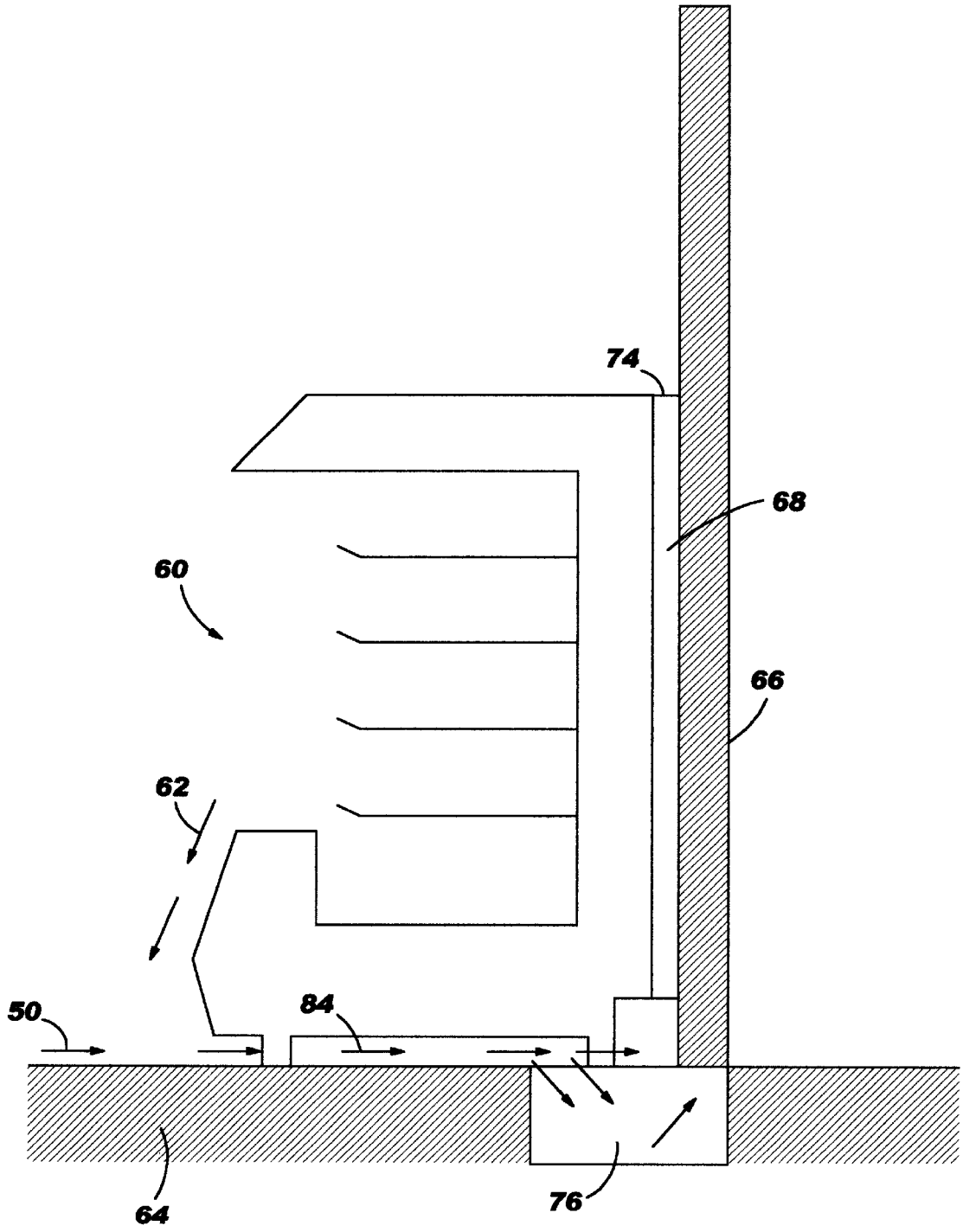
FIG. 5 is a perspective view of a trench style undercase return shown in association with a flow of return air.

FIG. 5 shows an alternate embodiment of the present invention that operates in association with an interior space having a trench style undercase return. Cold air 62 spills out of a refrigerated display case 60. The cold air 62 sinks to a floor 64 of the interior space. The cold air 64 combines with return air path 50. The cooled return air 84 circulates along the floor due to the action of a fan system in the interior space. A trench 76 is formed in the floor 64. The trench 76 communicates a return air duct (not shown). The cooled return air 84 sinks into the trench 76 and moves through the return air duct (not shown) to the main return air duct 36.

Figure 6:
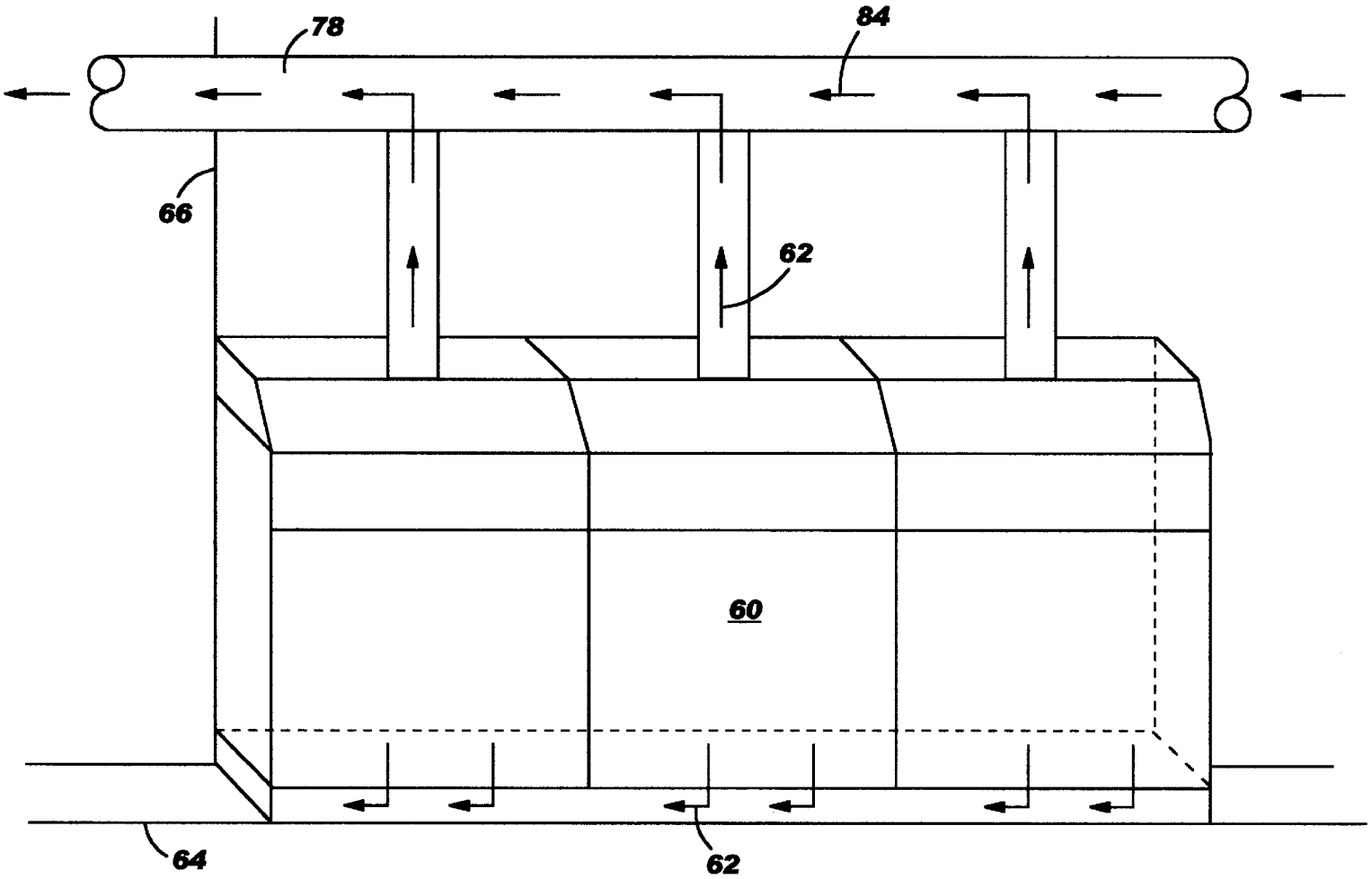
FIG. 6 is a perspective view of a duct drop style undercase return shown in association with a flow of return air.

FIG. 6 shows an alternate embodiment of the present invention that operates in association with an interior space having a spiral duct style undercase return. Cold air 62 spills out of a refrigerated display case 60. The cold air 62 sinks to a floor 64 of the interior space. The cold air 62 combines with return air path 50. The cooled return air 84 circulates along the floor and under the display case 60 to a gap (not shown) formed behind a wall 66 and the display case 60. Duct drops 80 extend behind the display case 60 into the gap (not shown). The cold air 62 is sucked into the duct drops 80 and moves into a spiral duct 78 which communicates with the main return air duct 36.

In an alternate embodiment, the return air duct inlets are located in the ceiling or grilles located in the walls and/or return air ductwork. When the return air enters the return air inlet 24 through these sources, the process is referred to as high level return.

Alternatively, under conditions where additional sensible cooling is required, it is possible to bypass the return air so that it joins the outside air stream before the outside air stream passes over the cooling coil. Sensible cooling refers strictly to temperature drop of the air. This is accomplished by directing the return air through bypass air path 45. In order to direct the return air through bypass air path 45, bypass damper 28 is moved toward the opened position and return air damper 34 is moved toward the closed position.

The system may include direct digital controls, with point capacity and memory. A typical points list could include the following:

ANALOG INPUTS

Outside air temperature
Supply air temperature
Space temperature
Return air temperature
Space dew point
Outside air R.H.
Outside air cooling coil leaving temperature
Outside air coil differential pressure
Outside air intake quantity (from airflow station)

ANALOG OUTPUTS

Outside air damper (2–10 VDC)
By-pass air damper (2–10 VDC)
Return air damper (2–10 VDC)
Modulating Gas Valve Control (0–10 VDC)

DIGITAL INPUTS

Outside air filter status
Return air filter status
Fan status
1.1 DIGIAL OUTPUTS
System enable (fan on/off)
Heating enable
Cooling stage #1 (as required, if chilled water or brine, an analog output would be used to control the flow via a valve)
Cooling stage #2
Cooling stage #3

Cooling stage #4

Fan high speed/low speed (normally open contact—high is open & low is closed)

Since modifications will be apparent to those of ordinary skill in the art, it is intended that this invention be limited only by the appended claims.

What is claimed is:

1. A dual path dehumidification system for dehumidifying air and circulating the air through an interior space defined by an exterior structure of a building, the air including outside air derived from an outside air source and return air from the space, a refrigeration unit being located in said space, the system comprising:

a supply inlet communicating with said space for passage of dehumidified air to said space;

an outside air path for passage of outside air to the supply inlet, the outside air path communicating between the exterior of the building and the supply inlet, said outside air path being connected to said outside air source;

a cooling unit disposed in said outside air path, the cooling unit including an inlet for receiving outside air and an outlet for flow of cooled and dehumidified outside air to said outside air path; and a return air path for passage of air in the space to the supply inlet, the return air path communicating with the refrigeration unit so that the return air passes near the refrigeration unit thereby cooling the return air, the return air path joining the outside air a path at a point between the cooling unit and the supply inlet;

a fan operatively connected to the outside air path, the return air path and the supply inlet for circulating the air through the outside air path, the return air path and the supply inlet.

2. A dual path dehumidification system according to claim 1 including a bypass valve for joining the return air path to the outside air a path at a point between the exterior of the building and the cooling unit to create a joined air stream so that the joined air stream passes through the cooling unit.

3. A dual path dehumidification system according to claim 2 wherein the bypass valve is a damper which is movable between an open position and a closed position, the air passing through the damper to create the joined air stream when the damper is in the open position.

4. A dual path dehumidification system according to claim 1 including a damper that regulates the flow of air from the outside air source into the outside air path.

5. A dual path dehumidification system according to claim 1 wherein the cooling unit includes a cooling coil.

6. A dual path dehumidification system according to claim 5 wherein the cooling unit includes a differential pressure transmitter for determining the amount of air passing across the cooling coil.

7. A dual path dehumidification system according to claim 1 wherein a heating unit is located near the supply inlet for heating the air delivered to the space.

8. A dual path dehumidification system according to claim 1 wherein the supply inlet includes a fan section, a fan being located in the fan section for delivering air to said space.

9. A dual path dehumidification system according to claim 1 wherein the return air path includes a duct located near the refrigeration unit for drawing air from the space to a position exterior to the space.

10. A system as set forth in claim 1 further comprising a control means for varying the amount of outside air delivered to said outside air path.

* * * * *